United States Patent [19]

Reed et al.

[11] 4,148,599

[45] Apr. 10, 1979

[54] METHOD TO MIX LIQUID FUELS WITH DILUENT GAS FOR A GASEOUS FUEL BURNER

[75] Inventors: Robert D. Reed; Hershel E. Goodnight, both of Tulsa, Okla.

[73] Assignee: John Zink Company, Tulsa, Okla.

[21] Appl. No.: 799,301

[22] Filed: May 23, 1977

Related U.S. Application Data

[63] Continuation-in-part of Ser. No. 579,466, May 21, 1975, Pat. No. 4,025,282.

[51] Int. Cl.[2] ..... F23D 11/44

[52] U.S. Cl. ..... 431/11; 261/128

[58] Field of Search ..... 431/11, 208, 210, 281, 431/284, 4, 3, 2; 261/128, 78 R, DIG. 33, DIG. 65

[56] References Cited

U.S. PATENT DOCUMENTS

| | | | |
|---|---|---|---|
| 1,987,401 | 1/1935 | Hillhouse | 431/11 |
| 3,238,991 | 3/1966 | Goldmann et al. | 431/11 |
| 3,291,191 | 12/1966 | Stoops | 431/11 |
| 3,326,262 | 6/1967 | Weller et al. | 431/208 X |
| 3,361,183 | 1/1968 | Reichhelm | 431/208 X |

*Primary Examiner*—Edward G. Favors

*Attorney, Agent, or Firm*—Head, Johnson & Chafin

[57] ABSTRACT

Apparatus to burn liquid fuels in a gaseous fuel burner, which includes preparatory apparatus for the atomization of liquid fuel oil preferably by a diluent gas, and the heating of the fuel droplets and diluent gas so as to completely vaporize the liquid fuel. If atomization is by other means, diluent gas is added prior to vaporization heating. The resulting oil vapor-diluent gas mixture then goes to a burner which utilizes the central orifice of a conventional gas burner. Primary air is induced into the burner tube due to the high velocity of jets of oil vapor-diluent gas. The diluent gas permits low vapor pressure of oil vapor and thus lower operating temperature. For the use of gaseous fuel, the same burner is utilized. The diluent gas can be preferably any noncombustible and non-oxygen containing gas.

7 Claims, 5 Drawing Figures

METHOD TO MIX LIQUID FUELS WITH DILUENT GAS FOR A GASEOUS FUEL BURNER

CROSS-REFERENCE TO RELATED APPLICATION

This application is a continuation-in-part of the co-pending application by the same inventors Ser. No. 579,466 entitled Apparatus to Burn Liquid Fuels in a Gaseous Fuel Burner, filed May 21, 1975 now U.S. Pat. No. 4,025,282.

BACKGROUND OF THE INVENTION

This invention lies in the field of fuel burning for heat supply. More particularly, it concerns the design of a burner and fuel system which can be used either with gaseous or liquid fuels.

Because of the restricted supplies of gaseous fuels which are typically in the natural gas category, it is at times necessary to burn liquid fuels as replacements for the normally used gaseous fuels, where fuel burning is required in the operation of industries, generally, but particularly, in the chemical and petroleum industries, where all functions of production result from the application of heat in some manner.

Such application of heat is typically carried out in process heaters of many shapes and forms, in which the delicacy and intimate control with which heat is applied, is at times quite critical. Gaseous fuels lend themselves well to critical firing. Thus, heaters are typically and preferentially gas fired. In view of increasing gas fuel shortage, this leads to problems of fuels firing which are serious because of the quite different characteristics of gas firing versus liquid fuel firing.

Many process heaters built during the time of ample gaseous fuel supplies are equipped with burners for gaseous fuel firing only. Alternative firing with typical liquid fuels, demand burners which are of the combination gas and oil type, which are well-known in the industry. Such alternation in fuel firing capability requires removal of the gas-only burners and replacement of them with combination gas-and-oil burners. This expedient is expensive and, due to time for burner change, it results in intolerable loss of critical product production.

BROADENING CONCEPTS OF THIS APPLICATION

This application is similar in many respects to the co-pending application Ser. No. 579,466, which describes and claims the method of using steam as a diluent gas for mixture with oil vapor so as to provide a gaseous mixture of oil vapor and steam, which, if under sufficient pressure, can be passed through a conventional burner, such as one which uses gas alone, under pressure.

However, the prior application also covers the situation where the resulting temperature of the oil vapor-diluent gas, or steam, is at a temperature such that the vapor is above its ignition point. Thus, as the vapor-steam issues from the orifice in the fuel supply line it would ignite into flame, with disastrous results. This flow of oil vapor and steam must be protected from contact with air until it is inside of, and mixes with, the air in the burner tube. This is provided by a screen of steam, which would issue from the annular orifice surrounding the fuel supply orifice in the burner.

We have found, that by careful attention to the partial pressure of the oil vapor and the steam or diluent gas, the resulting temperature of the oil vapor-steam mixture can be held low enough, so that when the mixture issues from the orifice it will be below the ignition point of the oil vapor. In that case, the gaseous mixture of oil vapor and steam or diluent gas is used in a manner identical to a gaseous fuel, both being under sufficient pressure, to issue from the orifice at sufficient velocity, to induce adequate primary combustion air. If the temperature of the vapor is low enough, then the shielding effect of the flow of steam or diluent gas through the annular orifice is no longer required, and the burner can be simplified to the conventional burner shown in FIG. 2. That is, a burner constructed like FIG. 3, but without the annular passage 86 and annular orifice 89.

Thus, the process of preparing the liquid fuel (which may be a hydrocarbon liquid or other liquid), is carried out as follows, including the steps of:

(a) atomizing the combustible liquid into small droplets;

(b) mixing the droplets with a selected diluent gas;

(c) heating said mixture of said liquid droplets plus diluent gas until the droplets vaporize and a mixture of combustible vapor plus diluent gas is formed; and (d) flowing this mixture of combustible vapor plus diluent gas under pressure through at least one orifice into a burner.

When the temperature of the mixture s low enough, and when the pressure of the mixture of oil vapor and diluent gas is high enough, this mixture can be used identically to the supply of a gaseous fuel to a conventional burner.

It has been found also that when the temperature is low enough, as provided by the proper vapor pressure of the combustible vapor, such that the temperature will be below the ignition point of the vapor, then the diluent gas can be any one of a variety of gases which are primarily non-combustible and non-oxygen containing such non-combustible, non-oxygen-containing gases as nitrogen, carbon dioxide, etc. are ideal for this purpose. Compressed flue gases, which have only a limited oxygen content, can also be used.

Also gases which have come calorific value, but which are too low in calorific value for normal burning, can be utilized as a diluent gas. Thus its calorific value can be salvaged, and will become part of the calorific value of the mixture of the diluent gas and combustible oil vapor mixture. This is a satisfactory heat energy conservation procedure of making otherwise unburnable low calorific value gases useful as fuels. In this instance the low calorific value gas provides the diluent gas which is required to maintain the proper partial pressure of the oil vapor, so as to be above its dew points, and below its ignition point, and also to be low enough so that a minimum quantity of heat is required in providing the oil vapor, by heating of liquid droplets.

Of course, steam can also be used as the diluent gas, since it is a noncombustible, non-oxygen-containing gas, as has been fully described in the co-pending application Ser. No. 579,466. The non-oxygen-containing feature of the diluent gas becomes important if the partial pressure of the vapor is such that its dew point temperature is not below the ignition point. In such cases, carbon dioxide, nitrogen, or steam can of course be used. Where the temperature is held to a low value then compressed stack gases can be used even though they do contain a small amount of oxygen.

Thus, we have found that the invention as described and claimed in the co-pending application can be broadened and simplified materially, by careful attention to the partial pressure of the oil vapor. By keeping the temperature of the diluent gas-oil vapor mixture low, then other types of diluent gas can be used besides steam, which may be more convenient, or cheaper to use than steam. Also the need for a more complicated burner such as shown in FIG. 3 may no longer be required, since there will be no need for shielding the mixture of oil vapor and diluent gas from the air, and thus the simple conventional burner of FIG. 2 can be used.

The emphasis in this application is the use of a more general diluent gas, which, while it includes the use of steam, includes also the use of noncombustible, nonoxygen-containing gases, noncombustible minor-oxygen-containing gases, as well as steam, where steam forms one element of the group that may be used.

One of the important features of this invention lies in maintaining the ratio of diluent gas to liquid fuel, such that the partial pressure of the liquid vapor is such as to permit a reduced temperature of the mixture, without condensing the liquid vapor. Further, the method preferentially requires that the temperature of the liquid vapor-diluent gas mixture be below the ignition point of the liquid vapor.

It is also possible to use as a diluent gas a combustible gas which has a relatively low heat value, and therefore cannot be burned in a conventional furnace. Here if the gas is at sufficient pressure, or can be raised to sufficient pressure to serve as a diluent gas, then full use will be made of its calorific value in the resulting combustion process.

It is possible also to utilize the energy of the pressurized diluent gas to produce the atomization of the liquid fuel and provide sufficient heating as well, prior to entering the heater. In other words, it is desirable to simplify the atomization process by providing the diluent gas under selected pressure and selected temperature.

SUMMARY OF THE INVENTION

It is a primary object of this invention to provide a fuel burning system in which either gas or liquid fuels can be burned alternately, without any change in equipment.

It is a further object of this invention to provide a liquid fuel burning system in which the liquid is fully vaporized prior to entering the burner so that the burning characteristic of the vaporized liquid fuel is substantially the same as that of gaseous fuels.

These and other objects are realized and the limitations of the prior art are overcome in this invention which will permit alternative burning of either gaseous or liquid fuels in the same burner, without necessity for burner change, and has the further advantage of provision of burning conditions for either gaseous or liquid fuels, which are essentially identical in burning characteristics, rather than quite different, as would be the case with combination gas and liquid fuel burners.

The burner is substantially similar to a gas fuel burner in that it has a central conduit and orifice through which gaseous or vaporized fuel is supplied. It may be modified, however, in that it has an annular passage surrounding the central gas and vapor passage, through which a diluent gas is supplied. The diluent gas issues through an annular orifice in a continuous cylindrical curtain or barrier, around the vapor flow. If gaseous fuel is used, it is supplied directly to the central conduit of the burner through appropriate controls, and the steam or diluent gas flow is cut off since it is unnecessary.

If liquid fuel is to be used, the liquid is atomized, into very small particles of liquid which have a high surface-to-mass ratio, and can be easily vaporized in a heater, through which the droplets diluent gas mixture flows. In the heater all of the liquid droplets are vaporized and a flow of oil vapor and diluent gas then proceeds to the burner, and enters through the central passage where gas would normally be flowed.

In some cases, it may be desirable to flow diluent gas through the annular orifice surrounding the central office, through which the vapor diluent gas mixture flows. The additional diluent gas flow may be desired because of its energy to induce sufficient primary air. A second reason for the diluent gas flow is to protect the flow of oil vapor which is now at a substantial temperature, as the result of the heating in the heater. The vapor is protected from contact with air by a screen of non-oxygen containing diluent gas until the fuel, diluent gas and air mix in the burner tube, are ignited at the outflow end of the burner tube.

BRIEF DESCRIPTION OF THE DRAWINGS

These and other objects and advantages of the invention and a better understanding of the principles and the details of the invention will be evident from the following description taken in conjunction with the appended drawings in which.

DESCRIPTION OF THE PREFERRED EMBODIMENT

Figures 1, 2:
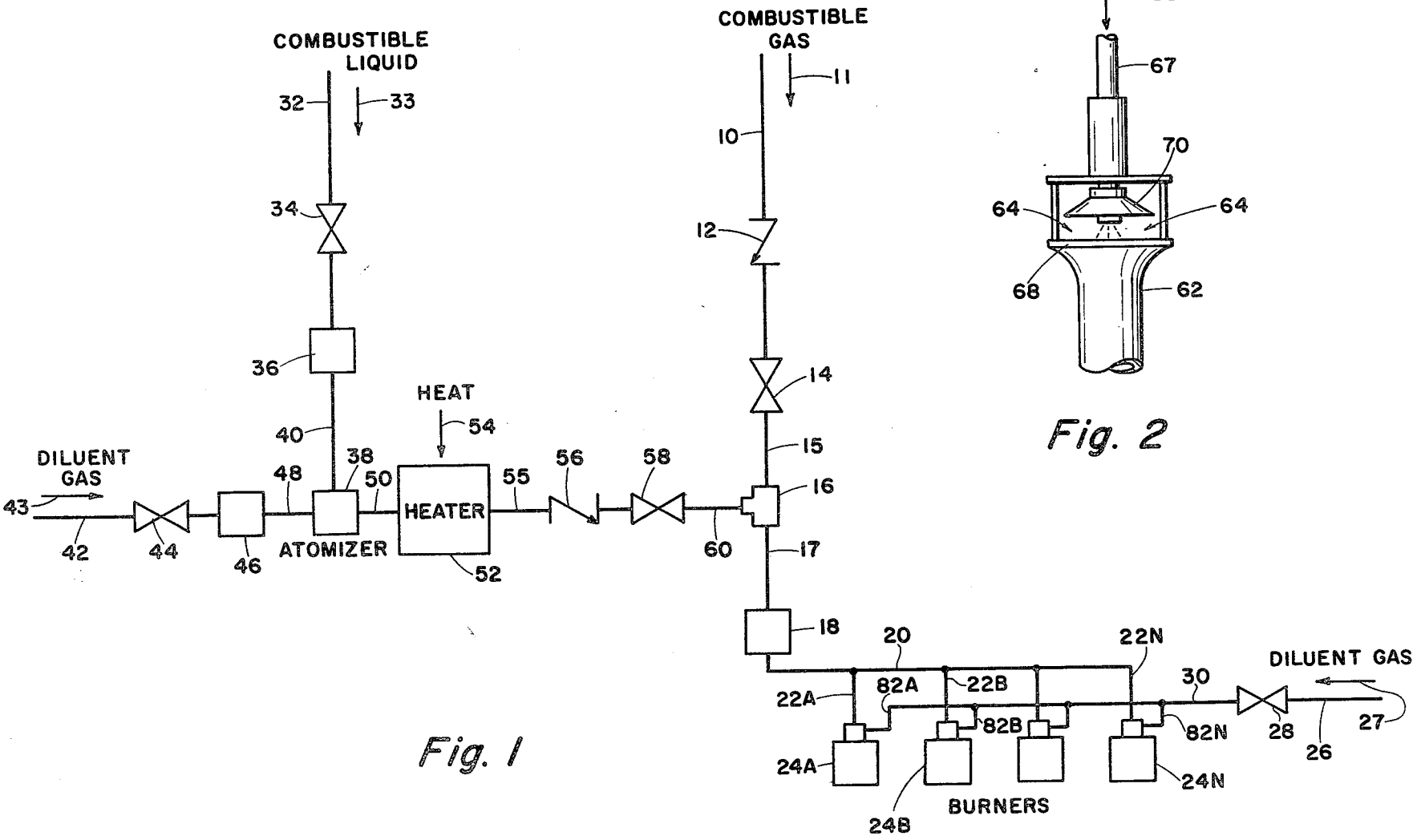
FIG. 1 represents schematically the fuel supply system to a battery of burners, where alternate oil or gas can be supplied as fuel.
FIG. 2 illustrates a conventional gaseous fuel burner.

Referring now to the drawings and in particular to FIG. 1, there is shown in schematic form the flow lines and controls of a combination gaseous and liquid fuel supply and burner system.

A single, or group of burners, 24A, 24B . . . 24N are shown which are to be supplied with gaseous or liquid fuel. If the fuel is gaseous, it would be supplied through a supply line 10 in accordance with arrow 11 to a check valve 12 and through a shut-off valve 14, through conduits 15 and 17, through a control and metering means 18, to a manifold 20 which supplies the gas through lines 22A, 22B . . . 22N.

FIG. 2 shows a conventional gaseous fuel burner in which gas is supplied through a pipe 67, in accordance with arrows 66 and provides a jet of gaseous fuel 68 when it issues from an orifice in the end of the pipe 67. The high velocity of the jet of gas entrains air and provides an induced flow of air in accordance with arrows 64. This is the primary air for combustion and is entrained with the high velocity stream of gas and is turbulently mixed inside of the burner tube 62, from which it issues and is ignited in a conventional manner. The shield 70 is provided so that it can be moved vertically so as to control the area of the opening through which the primary air 64 enters. No extra source of energy is required to provide sufficient primary air, because of the normal high pressure and high velocity of discharge of the gas supplied through the pipe 67.

Figure 3:
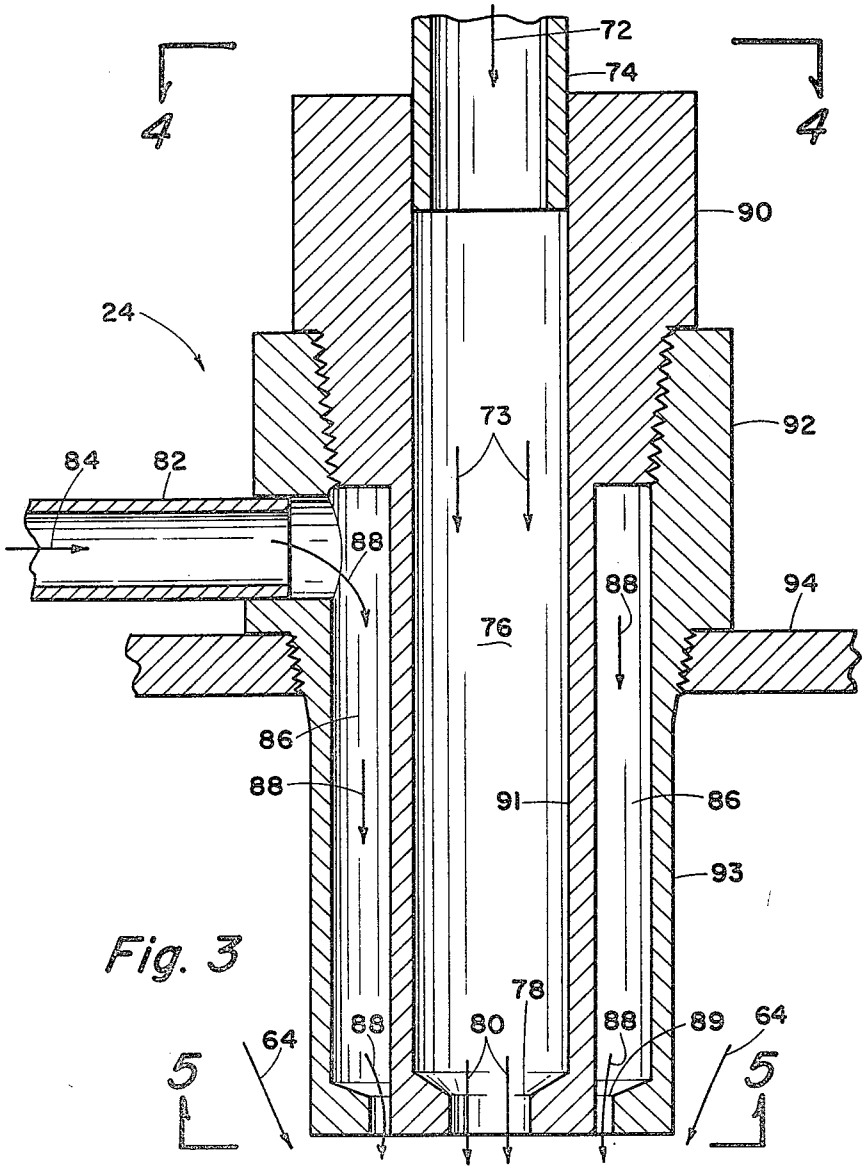

In this system, the normal gas burner, as shown in FIG. 2 can be used as shown, or can be modified as shown in FIG. 3, to have not only the central passage 76 through conduit 91 and orifice 78 supplied with gas in accordance with arrows 72, 73 and 80, but it has also an annular passage 86 through conduit 93, which surrounds the conduit 91 and terminates in an annular orifice 89, through which diluent gas is supplied, by means of pipe 82 in accordance with arrows 84, 88. The fuel to be supplied to the burner passage 76 is in the form of an oil vapor which is mixed with diluent gas but will not generally have the high discharge velocity which is characteristic of normal gaseous fuel as supplied. Consequently, diluent gas under suitable pressure is required to provide a high velocity stream of diluent gas in the form of a cylindrical curtain around the vapor flowing through the orifice 78. This high velocity stream of diluent gas provides the required induction of primary air. And as will be explained further, it serves to isolate the vapor flow 80 from contact with the primary air 64.

Referring back to FIG. 1, there is shown a conduit 32 supplying fuel oil in accordance with arrow 33 and a shutoff valve 34, with some metering device 36, if desired. The oil flow then passes through conduit 40 to an atomizer 38, of conventional form. Diluent gas under pressure flows through conduit 42 in accordance with arrow 43, through shutoff valve 44, and metering device 46 to the atomizer through conduit 48. The diluent gas provides the energy to atomize the oil into minute droplets of large area-to-mass ratio. Additionally, the diluent gas serves to preheat the oil for its passage through line 50 to a heater 52, wherein heat is applied in accordance with arrow 54, to the mixture of diluent gas and liquid droplets. The heater can be of any desired form. For example, it can be direct-fired or it can make use of waste-heat or it can use steam as heat sources for vaporization of oil droplets.

The final temperature should be high enough so that all of the liquid droplets will be vaporized. This might be in the neighborhood of 450 degrees. In any case, it is sufficient to vaporize all the liquid, and therefore the line 55 carries a mixture of diluent and oil vapor through a check valve 56, and a shut-off valve 58, and through line 60 to a tee 16 whereby the diluent gas vapor mixture can pass alternately to the gas flow, through the line 17 to the metering device 18 and to the burners 24.

Whenever the oil is being used, the gas flow is completely shut off by the shut-off valve 14. Conversely, when gas is being used the oil is shut off by the valve 34 and the diluent gas is shut off by the valve 44 and the valve 58 is further shut off to avoid leakage of gaseous fuel back into the heater system. Preferably, check valves 56 and 12 are also applied to prevent leakage of either fuel back into the fuel system not in use, in case of failure to obtain complete shut-off by valves 58 and 14.

Each of the burners 24 will be similar to the burner indicated in FIG. 2 or as indicated generally by the numeral 24 in FIG. 3. That is, it will provide the central passage for either gas along, or vapor and diluent gas mixture, flowing down through the central conduit 91 to orifice 78. Alternatively it may also have the annular passage 86 formed between the conduit 91 and an outer conduit 93 providing an annular orifice 89. Diluent gas would enter this annular channel through pipe 82 in accordance with the arrow 84 and flow down and around the annular chamber 86 and out through the orifice 89 in accordance with arrows 88.

FIG. 1 shows a separate diluent gas line 26 flowing in accordance with arrows 27 through a valve 28 and to each of the burners 24 by means of line 30 and through lines 82A, 82B . . . 82N to the burners 24.

Figure 4:
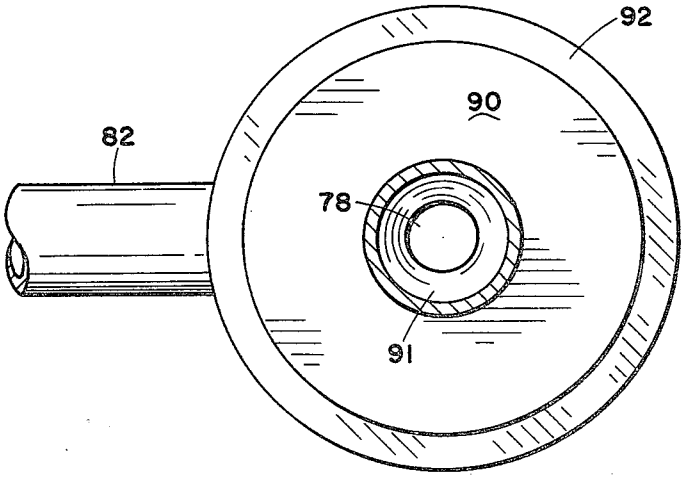
FIGS. 3, 4 and 5 show three views of a combination gas and vapor burner, according to the present invention.
Figure 5:
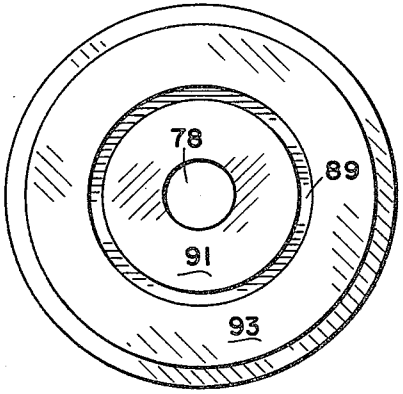

FIGS. 4 and 5 show other views of the burner 24.

FIG. 4 shows a view taken across the plane 4—4 of FIG. 3, while FIG. 5 shows a view of the two orifices of the burner, and is taken across th plane of 5—5 of FIG. 3.

In review, what has been shown in a modified gaseous fuel burner in which gas or oil vapor diluent gas mixture can be flowed axially through a conduit 91 to an orifice and into a burner tube, such as 62 of FIG. 2. When gas is used alone, that is the entire flow. When liquid is used and has been atomized and vaporized, and the fuel is in the form of a diluent gas vapor, the flow follows that of the gas down through the conduit 91 and orifice 78. However, when the diluent gas vapor is used, additional diluent gas may be applied through the pipes 82. This diluent gas issues at high velocity through the annular orifice 89. This high velocity diluent gas flow serves to induce sufficient primary air 64 for the complete combustion of the fuel.

However, there is a further reason for the diluent gas supply. In the vaporizing process in the heater 52, the temperature of the oil vapor may be above the temperature that it will spontaneously combust when mixed with air. In such a case, without the protection of the diluent gas in the form of a cylindrical screen, to isolate the hot vapor from the air 64, the vapor would flash into flame immediately after orifice 78, rather than at the outlet of the burner tube 62, and therefore would do great damage to the burner and other apparatus. Consequently, the steam serves the double purpose of inducing air, and protecting the oil vapor from contact with air, until it progresses down the burner tube 62 and issues at the open end of the tube in the furnace, or other chamber, in which the burning takes place.

The use of metering devices 36, 46 and 18 is optional, provided adequate flow control can be provided by means of the shut-off valves 34, 44, 58 and 14, respectively.

Once this system is set up, the fuel going to the burners can be switched rapidly from gas to liquid fuel, and vice-versa.

In fuels burning, some excess air is demanded for complete burning in avoidance of fuel wastage. However, too much excess air results also in fuel wastage and, is to be avoided. Since the kinetic energy for air inspiration with gaseous fuels is greater than that with preheated oil vapor-diluent gas as fuel, diluent gas may be supplied to supply supplemental energy whenever the change of fuel is from gaseous to oil vapor diluent gas.

No detail is shown of the atomizer 38 since there is no structural limitation. The function of the atomizer, which is typical of all atomizers, is to break up the liquid oil mass into droplets, which are best measured in microns, for great increase of the liquid surface-to-mass ratio. This provides rapid vaporization of the liquid, plus homogeneous mixture of liquid vapor and diluent gas.

While the invention has been described with a certain degree of particularity it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed:

1. A method of burning a combustible liquid in an apparatus equipped with at least one orifice for normally during combustible gas, comprising the steps of:

(a) atomizing said combustible liquid into very small droplets;

(b) mixing said small droplets with a concurrently flowing selected diluent gas in advance of heating;

(c) heating said mixture of liquid droplets plus diluent gas until said droplets vaporize, and a mixture of combustible vapor plus diluent gas is formed; and (d) flowing said mixture of combustible vapor plus diluent gas under pressure through said at least one orifice into a burner.

2. The method as in claim 1 in which the ratio of diluent gas to liquid fuel is such that the partial pressure of the liquid vapor is such as to permit a reduced mixture temperature without condensing liquid vapor.

3. The method as in claim 1 in which the temperature of the liquid vapor-diluent gas mixture is below the ignition point of said liquid vapor.

4. The method as in claim 1 in which said diluent gas is a non-combustible, non-oxygen-containing gas.

5. The method as in claim 1 in which said diluent gas is a non-combustible gas having a low percentage of oxygen such that the mixture of said liquid vapor-diluent gas can be maintained below the lower explosive limit.

6. The method as in claim 1 in which said diluent gas comprises a combustible, gas of low heat value such as to be unburnable in conventional furnaces.

7. The method as in claim 1 in which the diluent gas is supplied under selected temperature and pressure to facilitate the atomization and vaporization of the liquid fuel.

* * * * *